US011428490B2

(12) United States Patent
Buchel

(10) Patent No.: US 11,428,490 B2
(45) Date of Patent: Aug. 30, 2022

(54) INAUDIBLE FREQUENCY SUPPRESSOR

(71) Applicant: Big Horn Armory, Inc., Cody, WY (US)

(72) Inventor: Gregory E. Buchel, Cody, WY (US)

(73) Assignee: Big Horn Armory, Inc., Cody, WY (US)

( * ) Notice: Subject to any disclaimer, the term of this patent is extended or adjusted under 35 U.S.C. 154(b) by 0 days.

(21) Appl. No.: 17/129,238

(22) Filed: Dec. 21, 2020

(65) Prior Publication Data

US 2021/0190450 A1 Jun. 24, 2021

Related U.S. Application Data

(60) Provisional application No. 62/951,472, filed on Dec. 20, 2019.

(51) Int. Cl.
*F41A 21/30* (2006.01)

(52) U.S. Cl.
CPC ..... *F41A 21/30* (2013.01)

(58) Field of Classification Search
CPC ..... F41A 21/28; F41A 21/30; F41A 21/32; F41A 21/325; F41A 21/34; F41A 21/36
See application file for complete search history.

(56) References Cited

U.S. PATENT DOCUMENTS

| | | | | | |
|---|---|---|---|---|---|
| 1,901,138 | A * | 3/1933 | Barnes | F41A 21/30 | 89/14.3 |
| 2,451,514 | A * | 10/1948 | Sieg | F41A 21/28 | 89/14.3 |
| 2,883,781 | A * | 4/1959 | Harvey | F41C 27/06 | 42/105 |
| 5,333,529 | A * | 8/1994 | Brockman | F41A 21/38 | 42/79 |
| 5,357,842 | A * | 10/1994 | Reynolds | F41A 21/36 | 89/14.3 |
| 5,425,298 | A * | 6/1995 | Coburn | F41A 21/38 | 89/14.3 |
| 10,401,113 | B2 * | 9/2019 | Scharer | F41A 21/36 | |
| 2019/0086174 | A1 * | 3/2019 | Scharer | F41A 21/36 | |

* cited by examiner

*Primary Examiner* — Jonathan C Weber
(74) *Attorney, Agent, or Firm* — Warn Partners, P.C.

(57) ABSTRACT

A sound suppressor for a sound produced by a generator of rapidly expanding gaseous fluid is provided. The sound suppressor includes a sound suppressor body having an inner longitudinal through bore with an inlet and outlet. The sound suppressor inlet receives rapidly expanding gaseous fluid from the sound generator. The sound suppressor body has an outer body radially spaced from the longitudinal bore. The sound suppressor body has a plurality of individualized control volume ports fluidly connecting the through bore with the outer surface of the body.

20 Claims, 8 Drawing Sheets

INAUDIBLE FREQUENCY SUPPRESSOR

FIELD OF THE INVENTION

The present invention relates to sound suppressors for sounds produced by rapidly expanding gaseous fluids. More particularly the present invention relates to sound suppressors for firearms.

BACKGROUND OF THE INVENTION

Millions of Americans own guns and use them for hunting, sport, and security. Additionally, virtually all law enforcement personnel in America possess a firearm. To be a responsible gun owner, one must be able to safely operate their firearm. Therefore, a responsible gun owner must at least occasionally shoot their weapon to ensure that they can do so safely. The shooting of a firearm can generate a large amount of objectional noise, especially if the firing occurs in an indoor firing range. Therefor there is a need to provide a sound suppressor for firearms.

Sounds suppressors for firearms are known in the art. These devices attach to the end of a firearm and typically are designed with various baffles and are plated internally which muffle the sound of the "explosion" of the cartridge firing a bullet. These designs are much like using a muffler on an engine for a car for baffling and reducing the sound level exiting the tail pipe.

While these devices significantly reduce and/or disguise the sound of a bullet exiting a chamber. There typically remains noises from the shot which are audible to various degrees.

Therefore, it is desirable to provide a sound suppressor for a firearm that significantly reduces the sound heard and or provides an inaudible sound report which cannot be heard by the human ear (sound frequencies above 30 KHz are beyond human hearing). It is desirable to provide a sound suppressor that can reduce the recoil of a gun. It is desirable to provide a sound suppressor that can be customized for the gun it is utilized on. It is desirable to provide a sound suppressor that can be customized the operator that uses the gun.

SUMMARY OF THE INVENTION

To make manifest the above noted and other gainful desires, a revelation of the present invention is brought forth. In a preferred embodiment, the present invention endows a freedom of a sound suppressor for a sound produced by a generator of rapidly expanding gaseous fluid. The sound suppressor includes a sound suppressor body having an inner longitudinal through bore with an inlet and outlet. The sound suppressor body inlet receives rapidly expanding gaseous fluid from a sound generator. The sound suppressor body has an outer surface radially spaced from the longitudinal bore. The sound suppressor body has a plurality of individualized control volume ports fluidly connecting the through bore with the outer surface of the suppressor body.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
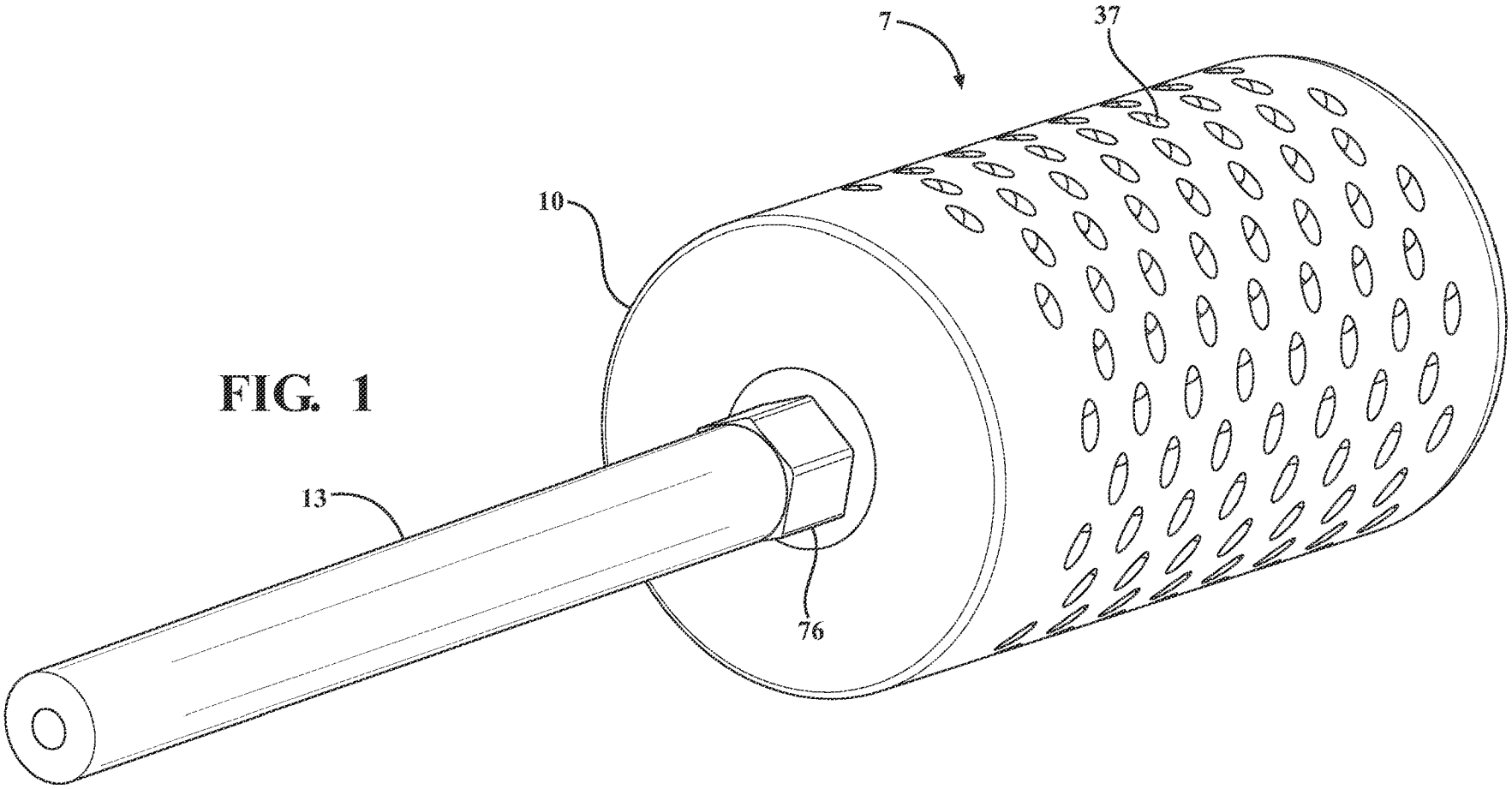
FIG. 1 is a perspective view of a sound suppressor assembly according to the present invention being shown connected to a gun barrel of a firearm (the upper receiver of the gun not being shown)
Figure 2:
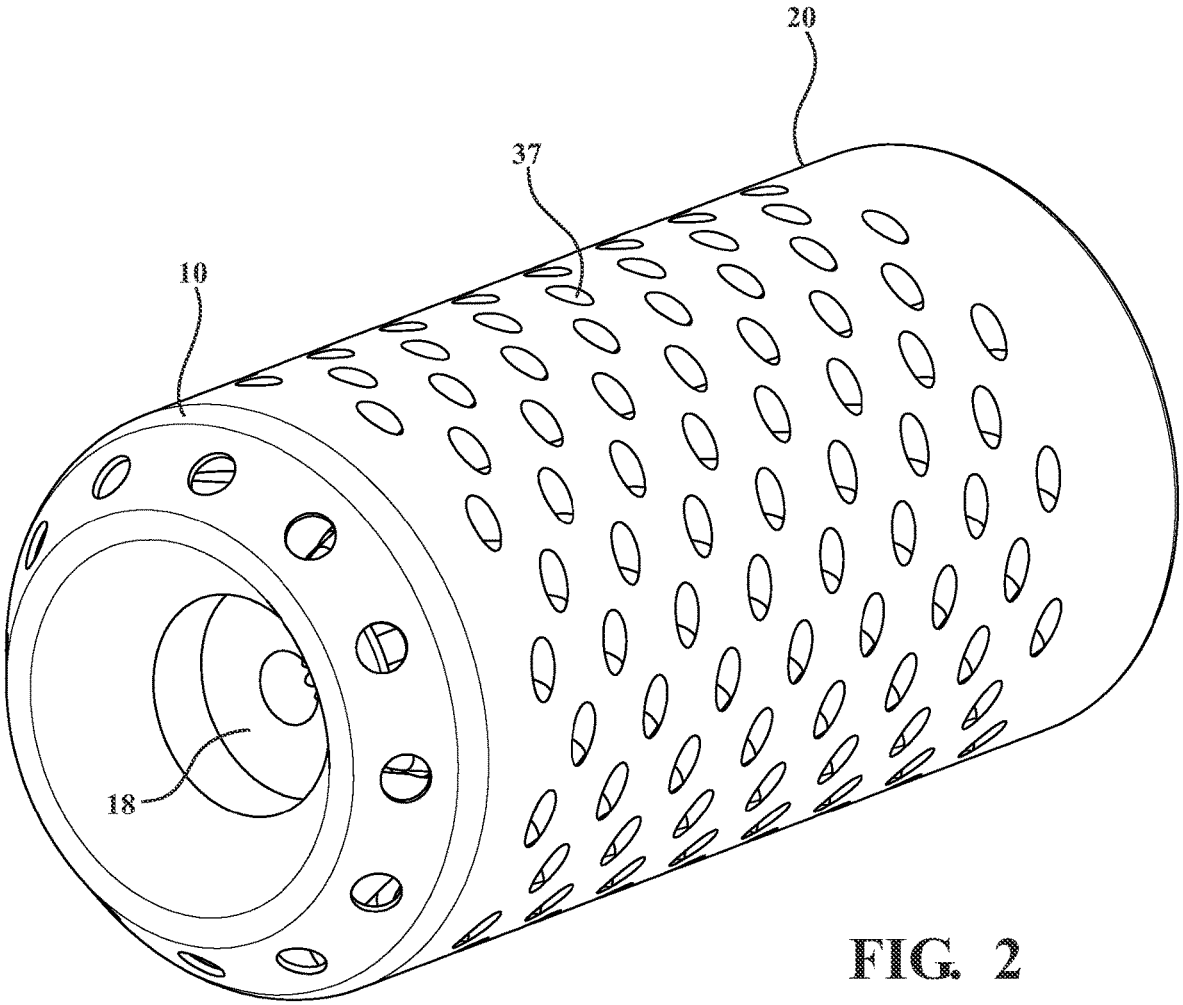
FIG. 2 is a rear perspective view of the body of the sound suppressor assembly show in FIG. 1.

The following description of the preferred embodiment(s) is merely exemplary in nature and is in no way intended to limit the invention, its application, or uses.

Referring to FIGS. 1-7, and 10, a preferred embodiment sound suppressor 7 for dampening a sound generated from a rapidly expanding gas is provided. The suppressor 7 can be utilized on a firearm or other sources of rapidly expanding gaseous fluids. The sound suppressor 7 has a cylindrical suppressor body 10 having in inner longitudinal through bore 14. Bore 14 has an inlet 16 and an outlet 18. If the sound suppressor 7 is utilized on a firearm the bore 14 size approximates slightly more than that of a gun barrel 13 inner diameter 15. Body 10 has an outer surface 20 radially spaced away from the bore 14. A plurality of serpentine individualized control volumes or paths, passages or as herein described ports 22 are provided to fluidly connect the through bore 14 with the outer surface 20. In the embodiment shown the ports 22 have an outer diameter surface allowing the body 10 to be essentially hollow. Body 10 is typically fabricated from a metal and is often fabricated primarily utilizing a three-dimensional printing technique. Body 10 typically will have an outer diameter of 2-5 inches.

At a minimum, there should be 40-60 ports and preferable many more. In the embodiment shown here are 15 axial rows of ports 22, each row of ports 22 having 12 radially geometrically spaces ports 22. The ports have a first minor portion 26 (FIG. 6) intersecting the bore 14. The port first minor portion 26 slants radially outward towards the exit 18 of the body (typically from 20-24 degrees from an axial centerline or z axis of the bore 14). The first minor portion 26 is curvilinear joined at an acute angle to a first major portion 30 that is slanted radially outward and toward the inlet 16 of the body. The first major portion 30 is curvilinear joined at an acute angle to a second major portion 34 that slants radially outward and toward the bore 14 exit 18. The second major portion 34 is curvilinear joined at an acute angle to a second minor portion 36 providing a sharp turn along the x axis and breaks the cylindrical surface 20 of the body at a slightly obtuse angle with the z axis and an acute angle with the y axis. A port exit 37 (FIGS. 1 and 2) provided by the intersection of the second minor portion 36 with the surface 20 has an elliptical shape. In the embodiment shown, when port entry 40 is at a 12:00 position, exit 37 is between 12:00-1:00 position.

Figure 5:
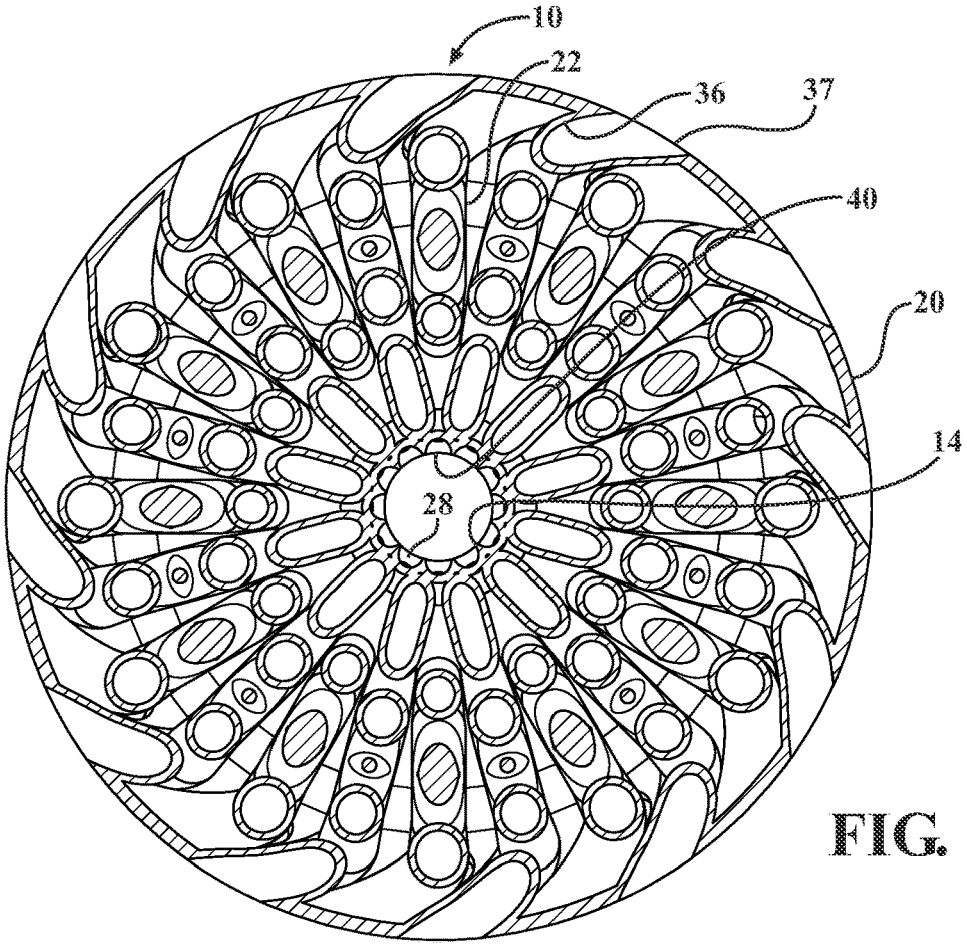
FIG. 5 is a sectional view taken transverse of the sound suppressor body shown in FIG. 4.
Figure 8:
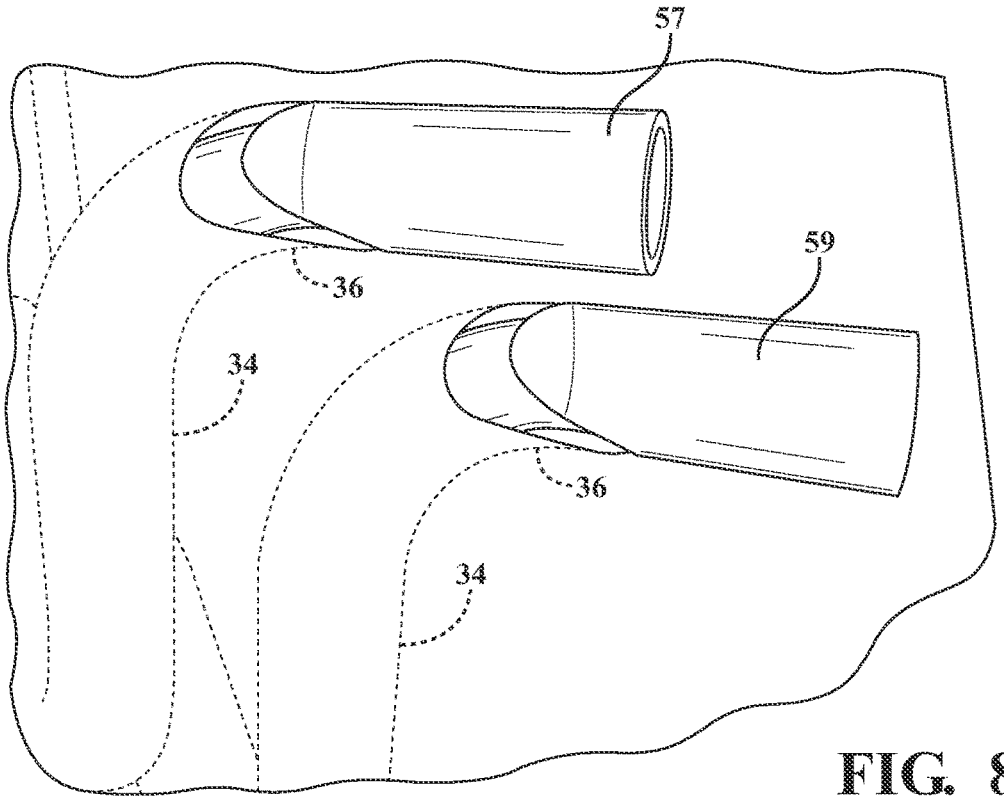
FIG. 8 is a schematic view illustrating the exit angles of the ports from the suppressor body.
Figure 9:
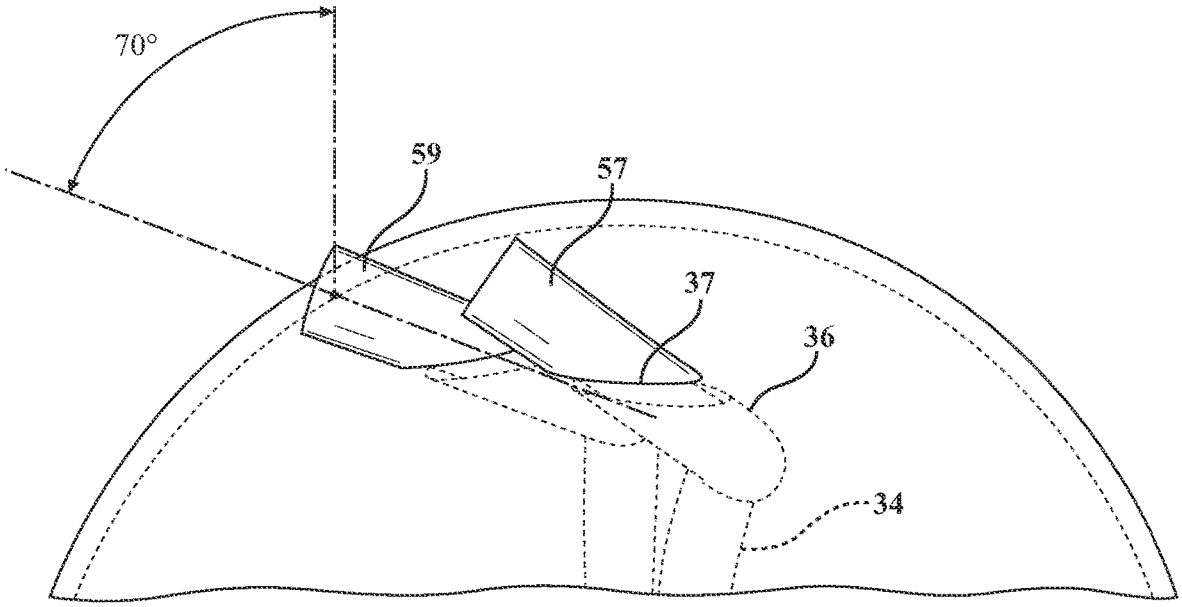
FIG. 9 is another schematic view illustrating the exit angles of the ports from the suppressor body.
Figure 10:
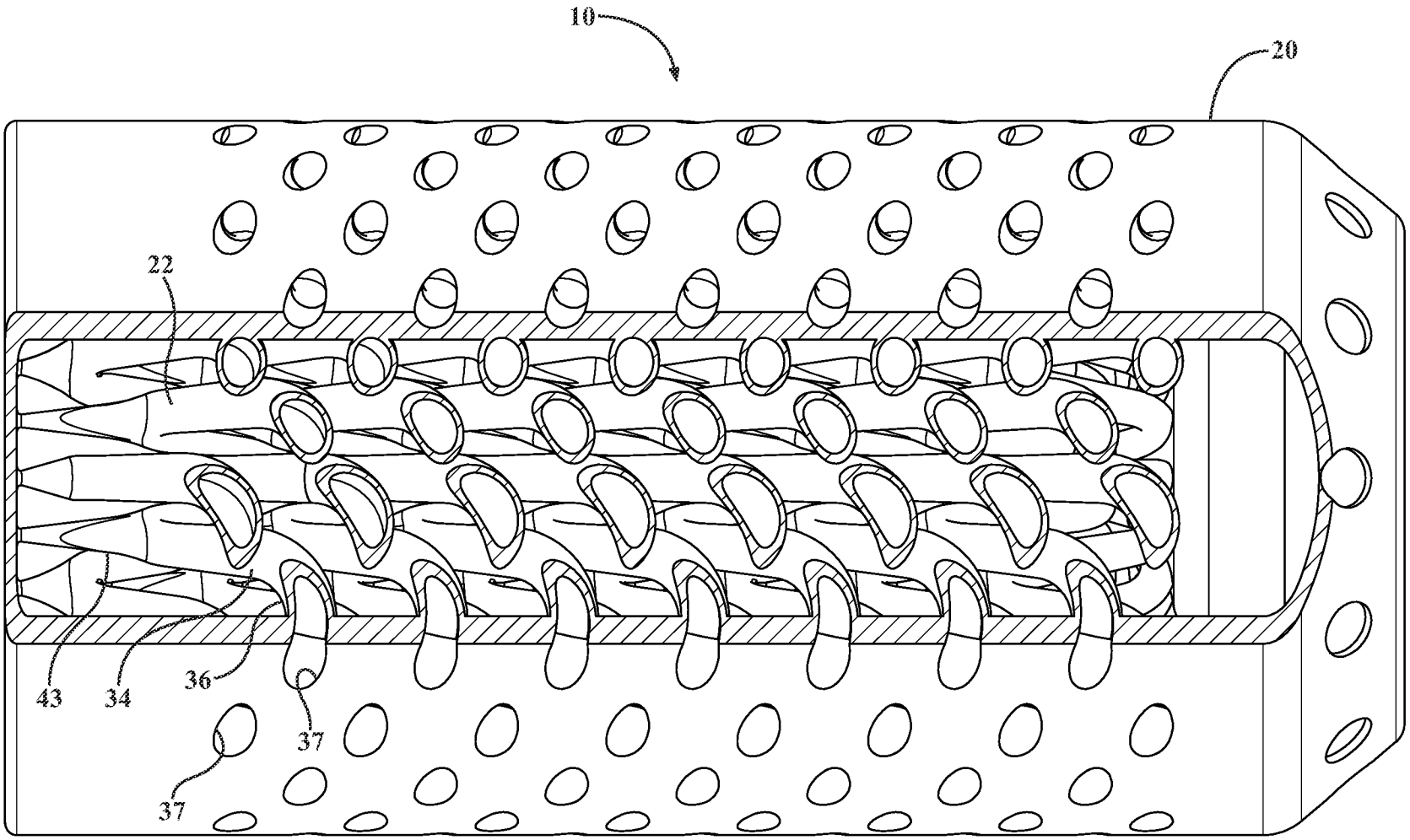
FIG. 10 is a sectional view illustrating the configuration of the ports is the exit the surface of the suppressor body.

FIG. 8 schematically illustrates the port exits 37 of axially sequential ports 22 on the outer surface on the body wherein the top of the view is oriented towards the exit 18 of the body. FIG. 9 schematically illustrates the port exits 37 of axially sequential ports 22 on the outer surface on the body wherein the top of the view is oriented towards the inlet 16 of the body. Schematic FIGS. 8 and 9 have added thereto exit cones 57 and 59 to illustrate the angular and divergent nature of the gases escaping the ports exits 37. In FIG. 9, the angular orientation of then gases directed out of exit 37 with respect to the y axis causes the suppressor body to rotate counterclockwise as shown in FIG. 5. The angular nature of the exit 37 causes gases exiting the port exit 37 to urge the body 10 forward (away from gun barrel 13, shown in FIG. 8).

To maximize the number of ports 22 the port intersections 40, 41 (FIG. 4) with the bore 14 are circumferentially angularly displaced with one another 15 degrees in a direction proceeding axially though the bore 14. The ports 22 have a continually increasing diameter from the bore 14 to the outer surface 20. In a typical example the port 22 transverse diameter varies from 0.075 inches to 1.61 inches. In most applications the ratio of the inner diameter to the outer diameter varies from a ratio of 1:1.5 to 1:2.3.

Figure 6:
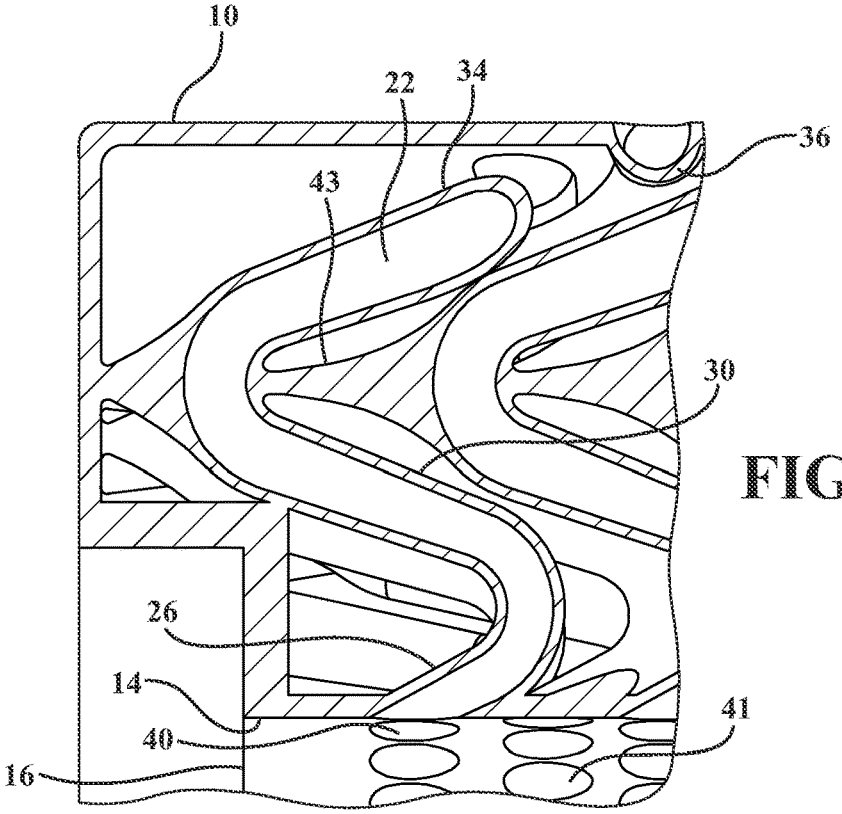
FIG. 6 is an enlargement of a portion of the sound suppressor body shown in FIG. 4.

The body outer surface 20 essentially forms a semi hollow cylindrical shell with an inner core perforated by the ports 22 intersections 40, 41 with the longitudinal bore 14. Axially alternating rows of ports 22 are supported from one another by support webs 43 (FIG. 6). The support webs 43 axially extend through the next row of ports 22 thus minimizing the volume displacement and mass of the suppressor body.

Figure 3:
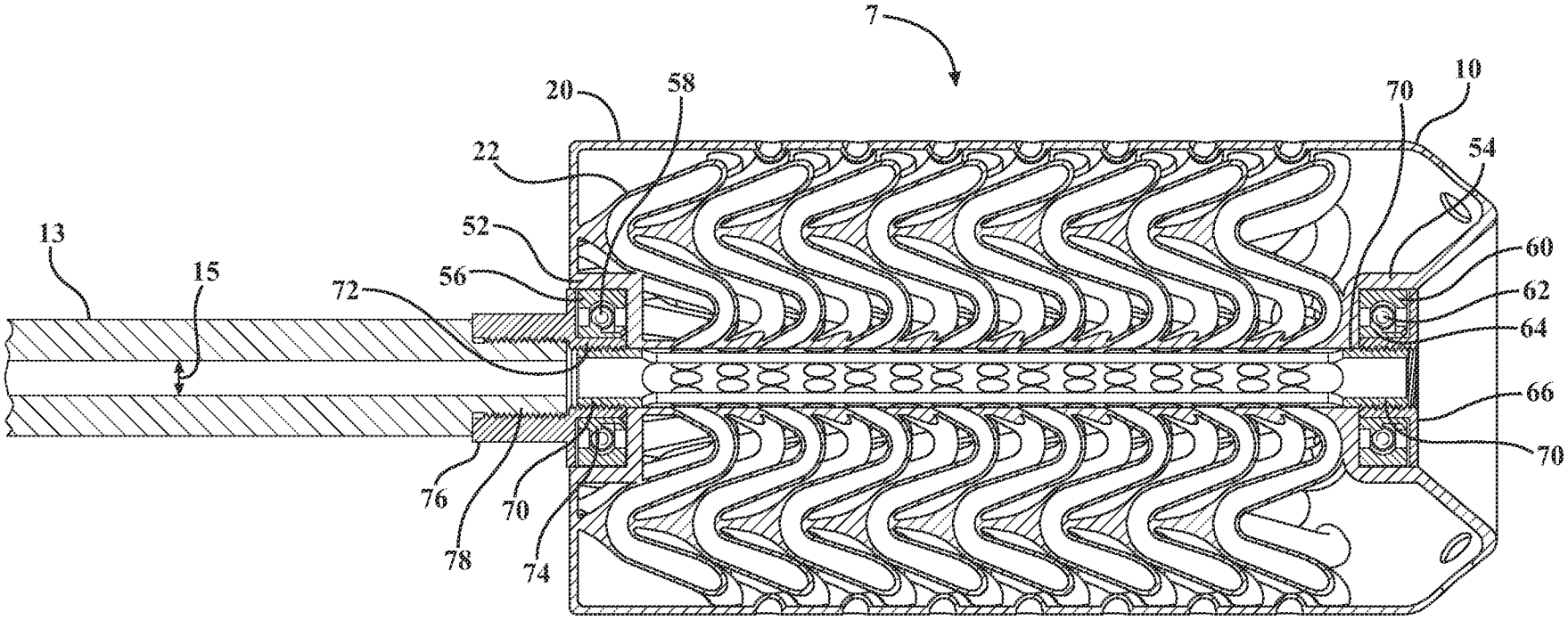
FIG. 3 is a sectional view of the sound suppressor assembly shown in FIG. 1.
Figure 4:
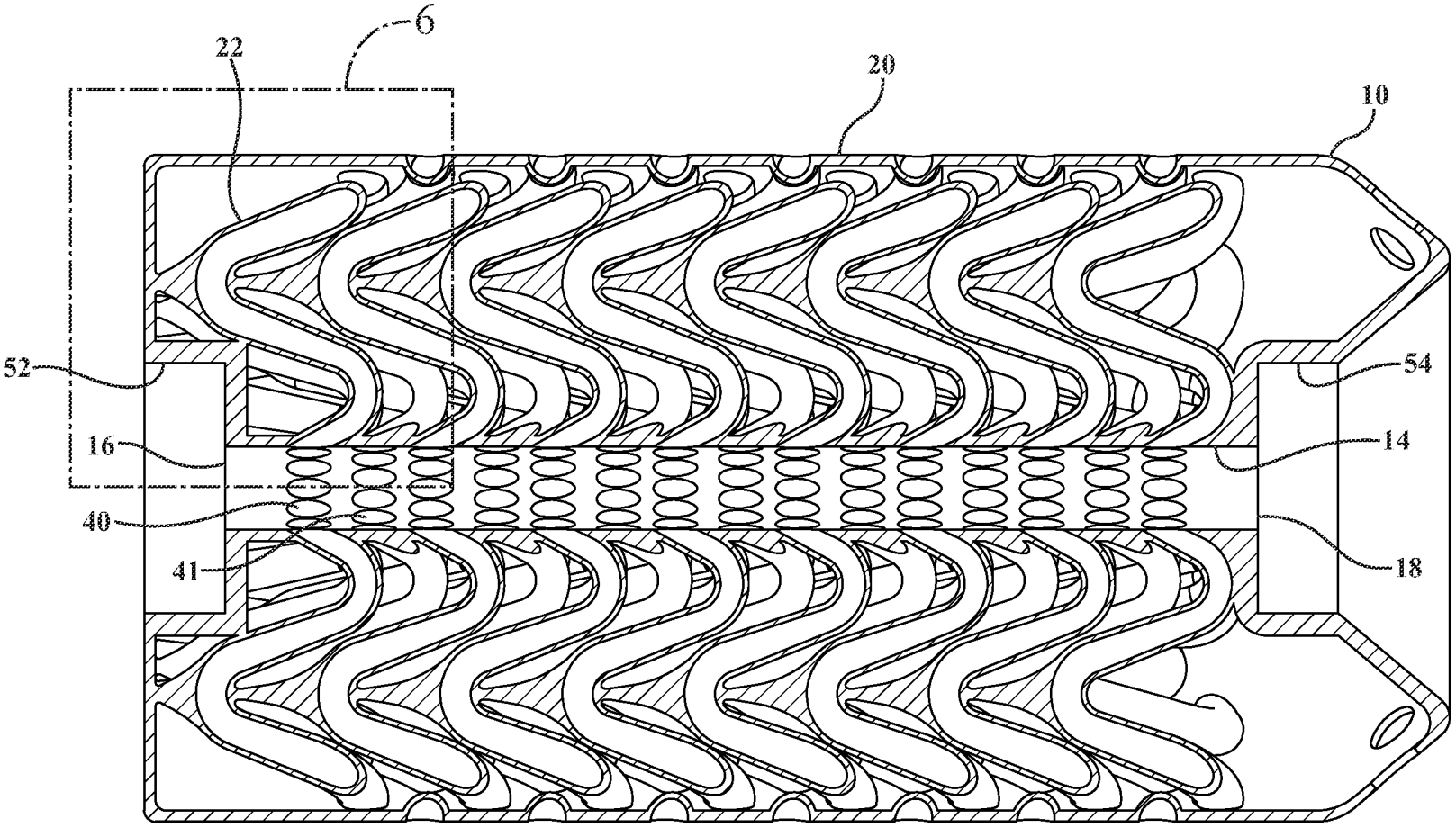
FIG. 4 is a sectional view of the body of the sound suppressor shown in FIG. 1 with the supporting bracket and front and rear bearings removed for clarity of illustration.

The suppressor body 10 has a front bearing mount 52 and a rear bearing mount 54 (FIGS. 3 and 4). The front bearing mount 52 accepts an outer race 56 of a front thrust bearing 58. The rear bearing mount 54 accepts an outer race 60 of a rear thrust bearing 62. Outer race 60 is angularly affixed with the body 10. An inner race 64 of the rear bearing mounts on thrust bracket 66. Thrust bracket 66 along its inner diameter is threadably connected with a hollow support bracket 70. Support bracket 70 extends through the bore 14 and along its front end is threadably connected via its outer diameter with a nut extension 72. An outer diameter of nut extension 72 is fixably connected with an inner race 74 of the front bearing 52. Nut extension 72 is integrally connected with barrel nut 76. Barrel nut 76 along its inner diameter is threadably connected on a threaded stud portion 78 of the gun barrel 13. The sound suppressor is typically an assembly having the body 10 combined with the support bracket 70, front and rear bearings 58 and 72 and nut 76 preassembled as a unit and then screwed onto the gun barrel 13.

Figure 7:
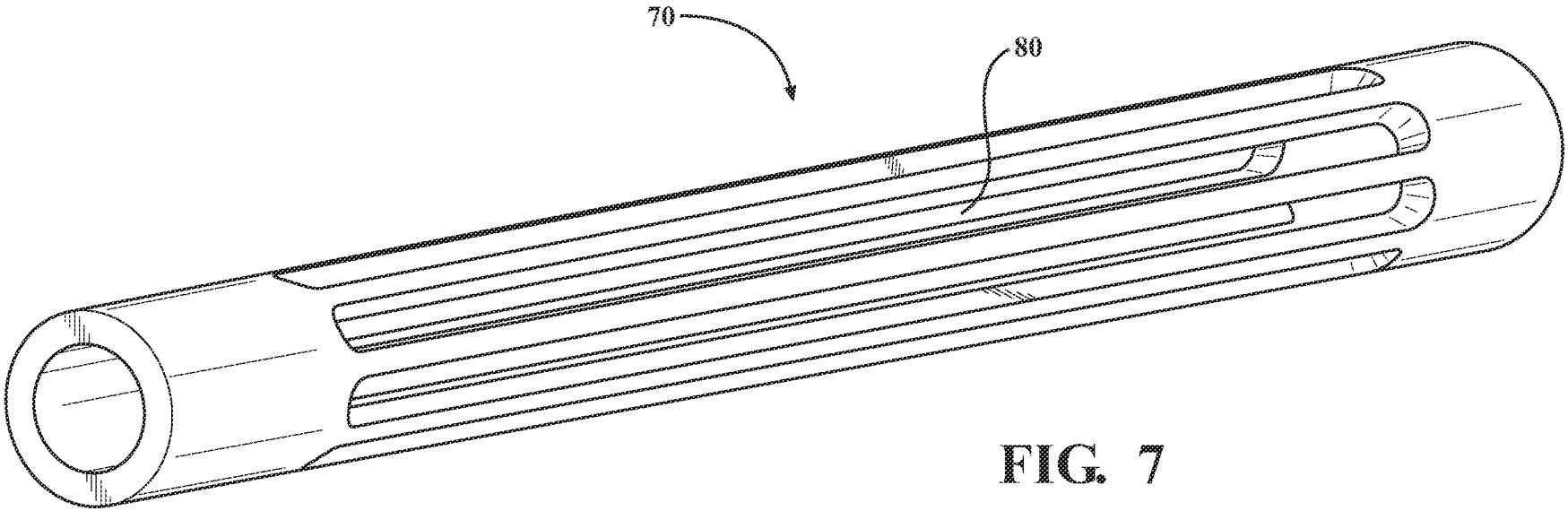
FIG. 7 is in large perspective view of a sound suppressor support bracket shown in FIG. 3.

In operation a shooter fires the weapon which includes the rifle barrel 13. Rapidly expanding gases are produced with an estimated exhaust speed of 4000 fps (approximately 3.5 times the speed of sound). The rapidly expanding gas enters the support bracket 70 and radially exits the support bracket 70 through elongated slots 80 provided in the bracket (FIG. 7). The gas then enters the ports 22 and exits the body outer surface via exits 37. The above noted action caused the gases to exit the suppressor body 10 at a subsonic speed of approximately 400 fps significantly reducing the sound signature. Since the gas speed is subsonic, there is no chance of a supersonic pop. The large number of ports 22, (at least 40 and preferably more than 80 and in the embodiment shown 180), a large volume of gas is captured, and no supersonic gases exit the suppressor exit 18. The wavy bend path of the ports 22 help to slow the exhaust gases and allow the unburnt gas and gun powder to burn within the suppressor, minimizing or eliminating the pop from unburnt materials igniting when exiting the muzzle end and mixing with atmospheric oxygen all at once. The ports 22 are turned to optimize rotation of the suppressor body 10. The rotational movement of the suppressor body 10 absorbs energy from the high speed—high pressure gases and allow more exhaust gas to be funneled through the suppressor body 10. The obtuse angular orientation of the port exits 37 about the z axis causes a recoil reduction once the bullet exits the barrel. The amount of recoil reduction can be tuned from large amounts of reduction which can pull the rifle out of the shooters hands all the way to an actual increase in recoil (an acute angle with the z axis or in other words an exit with a directional component slanted toward the suppressor body exit 18). This is dependent on which direction the ports are oriented with relation to the shooter and the bore. Therefore, customizing the recoil characteristic can be accomplished by simply changing the suppressor body 10 to one having a different exit 37 orientation.

The rotation of the suppressor body 10 is initiated by gas in front of the projectile that are compressed by the same. Rotation of the suppressor body is enhanced by the exhaust gases behind the projectile. The suppressor body 10 rotation provides a gyroscopic effect. The gyroscopic effect in conjunction with the recoil reduction allow a shooter to reacquire a target much faster. Finally, the frequency changing aspect of the port exits 37 on the outside surface 20 of the suppressor body mitigates any loud sounds which are not otherwise removed. The ports 22 can be configured to produce a sound component that is above 30 KHZ, beyond the range of human hearing.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A sound suppressor for a sound produced by a generator of rapidly expanding gaseous fluid comprising:

a sound suppressor body having an inner longitudinal through bore with an inlet and outlet, said inlet receiving rapidly expanding gaseous fluid from said generator, said sound suppressor body having an outer body radially spaced from said longitudinal bore, said body having a plurality of individualized control volume ports fluidly connecting said through bore with said outer surface of said body further including a bracket extending through said through bore, said bracket mounting said suppressor body on bearings on opposite axial sides of said body, said bracket being adapted for connection with said sound generator to allow said body to rotate along an axis of said through bore with respect to said gas generator.

2. The sound suppressor of claim 1 wherein there are at least 40 ports.

3. The sound suppressor of claim 1 wherein said ports have a transverse diameter increasing along a length of said ports from said through bore to said body outer surface.

4. The sound suppressor of claim 3 wherein a ratio of said radial inner diameter to said outer diameter is between 1:1.5 to 1:2.3.

5. The sound suppressor of claim 1 wherein said ports have a first major portion inclined radially outward and towards one of said longitudinal board inlets or outlets.

6. The sound suppressor of claim 5 wherein said ports have a second major portion incline radially outward towards said other one of said longitudinal bore inlet or outlet.

7. The sound suppressor of claim 1 wherein said ports have a first minor portion incline radially outward towards said other one of said longitudinal bore inlet or outlet connecting said port first major portion with said longitudinal bore.

8. The sound suppressor of claim 7 wherein ports said first minor portion is inclined toward said longitudinal bore outlet and said ports have a second major portion incline radially outward towards said longitudinal bore outlet.

9. The sound suppressor of claim 1 wherein ports exit at an obtuse angle with said z axis toward said though bore inlet.

10. The sound suppressor of claim 9 wherein said ports have an exit with said body acute angled with respect to a y axis.

11. The sound suppressor of claim 1 wherein said sound suppressor tends to urge toward said longitudinal bore exit upon entry of the rapidly expanding gas.

12. The sound suppressor of claim 1 wherein subsequently axially spaced ports have intersections with said longitudinal bore radially offset with one another.

13. The sound suppressor of claim 1 wherein said ports have intersections with said longitudinal bore at an acute angle of 20-24 degrees from said z axis.

14. The sound suppressor of claim 1 wherein said ports generate a sound component above 30 KHZ.

15. A firearm having a barrel for firing a projectile thus generating rapidly expanding gaseous fluid, said barrel having connected thereto a sound suppressor of claim 1.

16. A sound suppressor for firearm comprising:

a cylindrical sound suppressor body having an outer cylindrical surface and an inner longitudinal through bore with an inlet and outlet, said inlet receiving rapidly expanding gaseous fluid from a barrel of said firearm, said suppressor body being connected to said firearm via a bearing, said sound suppressor body having an outer body radially spaced from said longitudinal bore, said body having at least a plurality of 60 or more individualized fluid control volume ports fluidly connecting said through bore with said outer surface of said body, having a first minor portion intersecting said through bore at an acute angle with a z axis and a first major portion inclined radially upward toward said through bore inlet and a second major portion radially outwardly toward said though bore outlet and a second minor portion acutely angled along said x axis inclined toward said through bore inlet and wherein said port has a continually expanding inner diameter and wherein said suppressor body is urged to rotate and is urged in a forward direction to counter recoil forces upon firing of said firearm.

17. The sound suppressor of claim 16 further including a slotted hollow bracket extending through said bore rotativly mounting opposite ends of said body, said bracket being threadably connected with a gun barrel via a nut fastener.

18. A method of suppressing sound produced by a generator of rapidly expanding gaseous fluid comprising:

providing a sound suppressor body having an inner longitudinal through bore with an inlet and outlet, said inlet receiving rapidly expanding gaseous fluid from said generator, said sound suppressor body having an outer body radially spaced from said longitudinal bore, said body having a plurality of individualized control volume ports fluidly connecting said through bore with said outer surface of said body;

rotativity connecting said sound suppressor body with respect to said sound generator to receive rapidly extending gases;

suppressing sound produced by said rapidly expanding gases by absorbing energy from said gases by rotation of said sound suppressor body.

19. The method of claim 18 further comprising suppressing sound by producing a component of sound at or above 30 KHZ.

20. The method of claim 18 further comprising changing a recoil force on said sound generator by replacing said sound suppressor body with a substantially identical sound suppressor body having a different exit angle of ports on said suppressor body.

* * * * *